United States Patent [19]

Kellstadt

[11] Patent Number: 4,815,684

[45] Date of Patent: Mar. 28, 1989

[54] LADDER ENGAGED PAINT PAN SUPPORTING DEVICE

[76] Inventor: Charles E. Kellstadt, 61691 Shaw Rd., Cambridge, Ohio 43725

[21] Appl. No.: 140,641

[22] Filed: Jan. 4, 1988

[51] Int. Cl.[4] ..... E06C 7/14

[52] U.S. Cl. ..... 248/210; 248/311.2

[58] Field of Search ..... 248/210, 238, 214, 311.2; 15/257.06, 257.05, 104.92; 182/129, 120, 121; 220/1 R

[56] References Cited

U.S. PATENT DOCUMENTS

| | | | |
|---|---|---|---|
| 248,014 | 10/1881 | Boardman . | |
| 606,763 | 7/1898 | Lukens | 248/238 |
| 1,112,511 | 10/1914 | Winn . | |
| 2,174,891 | 10/1939 | Maran | 248/210 X |
| 2,252,025 | 8/1941 | Olson . | |
| 2,439,185 | 4/1948 | Patt | 248/210 X |
| 2,444,096 | 6/1948 | Faust | 248/238 X |
| 2,496,057 | 1/1950 | Lombard et al. . | |
| 2,606,079 | 8/1952 | White . | |
| 2,871,067 | 1/1959 | Brogdon | 182/127 |
| 3,009,677 | 11/1961 | Munnikhuysen . | |
| 3,738,601 | 6/1973 | Gehringer | 248/210 |
| 4,401,187 | 8/1983 | VanPatten | 182/121 |
| 4,437,544 | 3/1984 | Anderson et al . | 182/120 |
| 4,618,030 | 10/1986 | Campbell | 182/121 |

FOREIGN PATENT DOCUMENTS

| | | | |
|---|---|---|---|
| 139644 | 5/1949 | Australia | 182/121 |
| 653256 | 12/1962 | Canada | 15/257.06 |

*Primary Examiner*—J. Franklin Foss

*Attorney, Agent, or Firm*—Michael Sand Co.

[57] ABSTRACT

A device for removably supporting a paint pan on the rungs of a ladder, wherein said pan is of the type having at least one hook depending therefrom and having a paint well. A shelf comprising a pair of V-shaped brackets, each having a horizontal leg and an inwardly extending leg, is removably mounted on one rung of the ladder by engagement of the terminal ends of the horizontal legs therewith. First and second crossbars extend between the horizontal legs to connect the brackets. A pair of struts are adjustably attached to the inwardly extending legs of the brackets, and an opposite end of the struts removably engages a second rung next below the ladder rung engaged by the shelf. A paint pan is removably mounted on the shelf by engagement of the pan hook with the first crossbar, and the pan well is supported by the second crossbar. The brackets are formed by lightweight, flexible metal straps which are manually bendable at the junction of the horizontal and inwardly extending legs, which when combined with the adjustably mounted struts enables the device to be used on ladders having a non-standard separation between adjacent rungs.

4 Claims, 2 Drawing Sheets

LADDER ENGAGED PAINT PAN SUPPORTING DEVICE

TECHNICAL FIELD

The invention relates to a device for removably supporting a usual paint pan on rungs of a ladder, and in particular to a device which is removably mounted on adjacent rungs of a ladder and on which a paint pan is removably supported. More particularly, the invention relates to an improved paint pan supporting device formed of flexible metal straps, whereby the device is manually bendable and adjustable for adapting the device for use on ladders having a non-standard separation between adjacent rungs.

BACKGROUND ART

Paint pans of the type having a hook or hooks which extend downwardly therefrom and have a paint well formed at one end of the pan have been utilized for many years by professional painters and do-it-yourselfers alike. The primary advantage to the use of such paint pans resides in the ease with which paint is neatly dispensed onto a roller, which is typically used to paint large areas where use of a paint brush would inordinately increase the time required to complete the job. It is nearly impossible to dispense paint onto a roller without first transferring the paint from the can in which the paint is packaged and sold and into a paint pan.

Such paint pans are designed to be removably mounted on slat-type ladders by engagement of the hooks with the slats, with such ladders being designed to elevate the user to a maximum height of approximately six feet off the ground.

When an area to be painted requires the painter to position himself or herself at heights greater than six feet off the ground, a rung-type ladder is typically employed. However, paint pans of the type described above are not designed to be supported on the rungs of such ladders, thereby making it impractical for the painter to use the pan as a paint dispenser. Therefore, the advantages of utilizing such a paint pan are often outweighed by the difficulty encountered in properly supporting the pan on a ladder when a rung-type ladder is used to reach the area to be painted. The rungs do not provide sufficient support for the pan, and attempts to rig the paint pan for use on a rung ladder often result in spilled paint and problems for the painter.

Many prior arts supporting devices which are removably mounted on a ladder are shown in U.S. Pat. Nos. 248,014; 1,112,511; 2,252,025; 2,496,057; 2,606,079; 3,738,601; 4,401,187; 4,437,544; and 4,618,030. The devices disclosed in these patents function as one or all of the following: a step, a shelf, a staging support, or a paint can holder. Although these previous devices satisfactorily perform their intended functions, none of the devices would satisfactorily support and secure a paint pan in a horizontal orientation on a rung or rungs of a ladder without interfering with the path of movement of a painter.

The closest known prior art to my improved paint pan supporting device is disclosed in U.S. Pat. No. 3,009,677. However, there are significant differences between the device of the present invention and the device shown in this patent. First, the device of the present invention has a crossbar which engages the hook or hooks depending from the paint pan for quick and secure removable supporting of the pan on the device to prevent spillage of paint from the pan. In contrast, a paint pan must be snap-fitted into a saddle of this prior art device which prevents any loose play of the pan when it is removably mounted on the device. Secondly, the device of the present invention engages adjacent rungs of a ladder and is independently removably mounted thereon. In comparison, the prior art device engages only one rung of a ladder, with the depending hook or hooks of the paint pan engaging the ladder rung next above the rung engaged by the support device. Thus, this prior art device is not independently removably mounted on the ladder as is the device of the present invention, but rather remains engaged with a rung of a ladder only when a paint pan is mounted on the device and the pan hooks are engaged with a ladder rung.

Accordingly, the need exists for a paint pan supporting device which is quickly and easily removably mounted on adjacent rungs of a ladder for removably supporting and securing a paint pan thereon to prevent spillage of the paint contained therein. Furthermore, the need exists for such a device which is adjustable for adapting the device for use on ladders having a non-standard separation between adjacent rungs, and which is formed of a lightweight flexible material which is durable and economical to manufacture.

DISCLOSURE OF THE INVENTION

Objectives of the invention include providing an improved paint pan supporting device which is removably mounted on adjacent rungs of a ladder for removably securely supporting a paint pan thereon.

Another objective of the invention is to provide an improved device which is adjustable for adapting the device for use on ladders having a non-standard separation between adjacent rungs.

A further objective of the invention is to provide such an improved device which is lightweight, sturdy and economical to manufacture.

Still another objective of the invention is to provide an improved device which is removably mounted on a ladder without interfering with the path of movement of a painter thereon.

These objectives and advantages are obtained by the improved paint pan supporting device of the invention, the general nature of which may be stated as including, a shelf comprising a pair of spaced, generally V-shaped brackets, each bracket having a horizontal leg and an inwardly extending leg, said horizontal legs each terminating in a downwardly extending end flange for removably engaging a rung of a ladder; a first crossbar extending between the horizontal legs and located generally adjacent the end flanges thereof for engaging the paint pan hook; and a pair of struts each adjustably attached at a first end thereof to the inwardly extending legs of the V-shaped brackets, each of said struts further having a bent second end for removably engaging a rung next below the ladder rung engaged by the shelf to position the horizontal leg for removably supporting the paint pan thereon.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
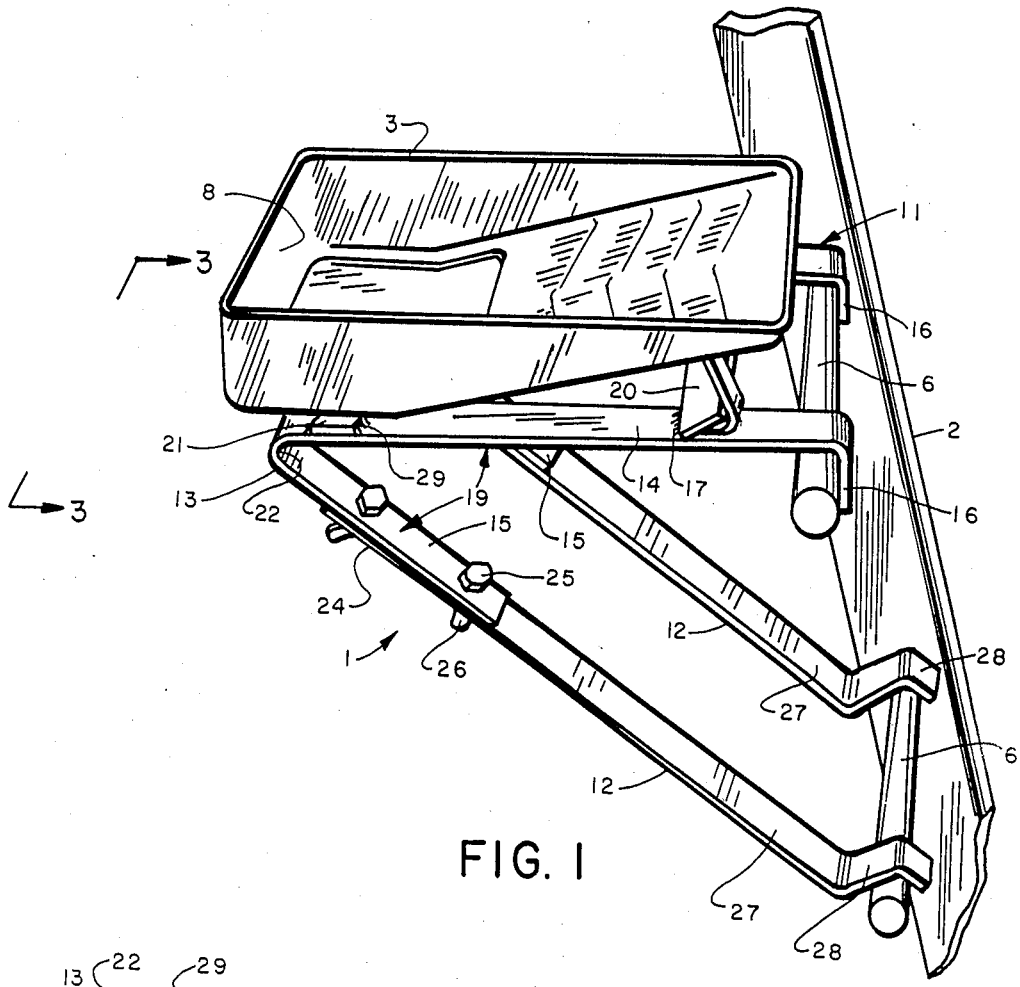
FIG. 1 is a perspective view of the paint pan supporting device of the invention, shown mounted on adjacent rungs of a ladder having one of its side rails removed for clarity, and showing a usual paint pan removably supported by the improved device.
Figure 2:
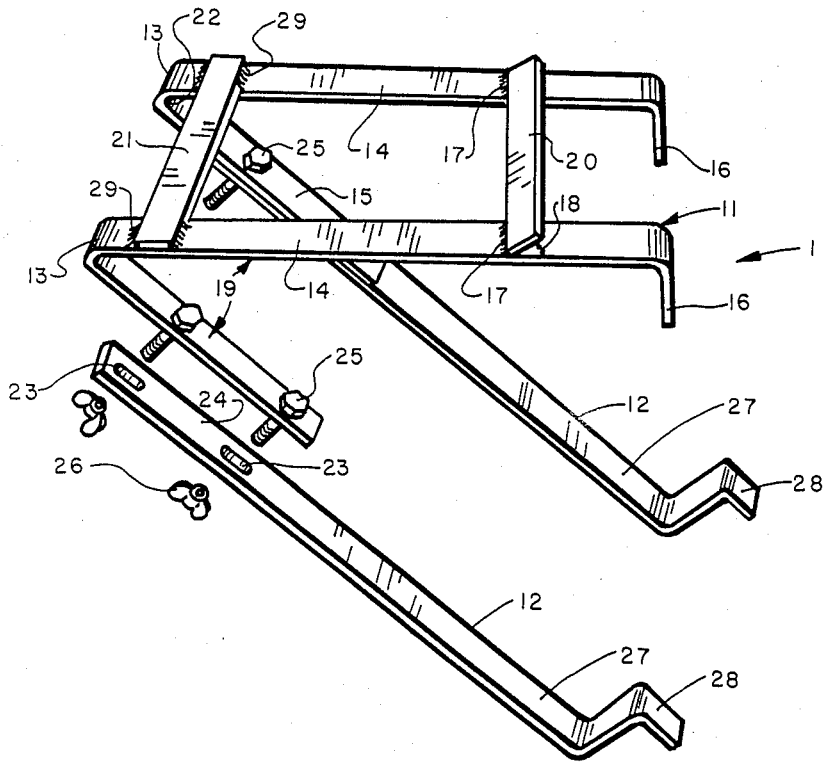
FIG. 2 is a partially exploded perspective view of the improved device.

The improved paint pan supporting device of the present invention is indicated generally at 1, and is shown particularly in FIG. 2. Paint pan supporting device 1 is adapted for use with a usual rung-type ladder 2 and a usual paint pan 3, and is shown in its intended use removably mounted on ladder 2 and supporting paint pan 3 in FIGS. 1, 3 and 4.

Figure 3:
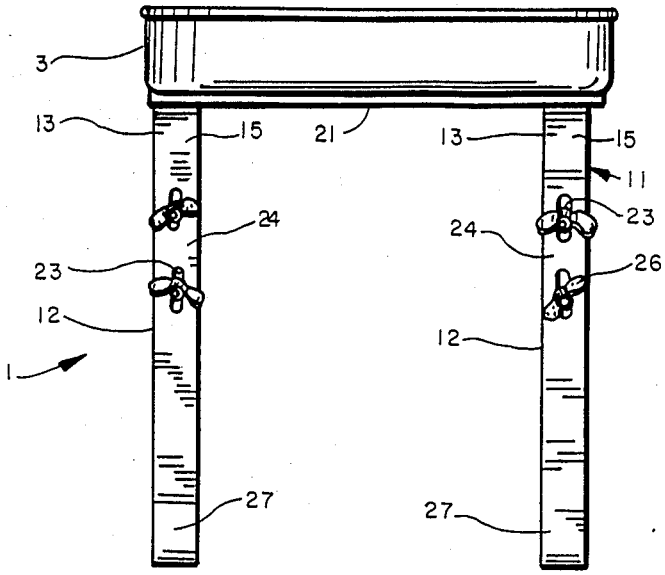
FIG. 3 is a view looking in the direction of arrows 3—3, FIG. 1, particularly showing the manner in which the second crossbar supports the paint well of the pan.
Figure 4:
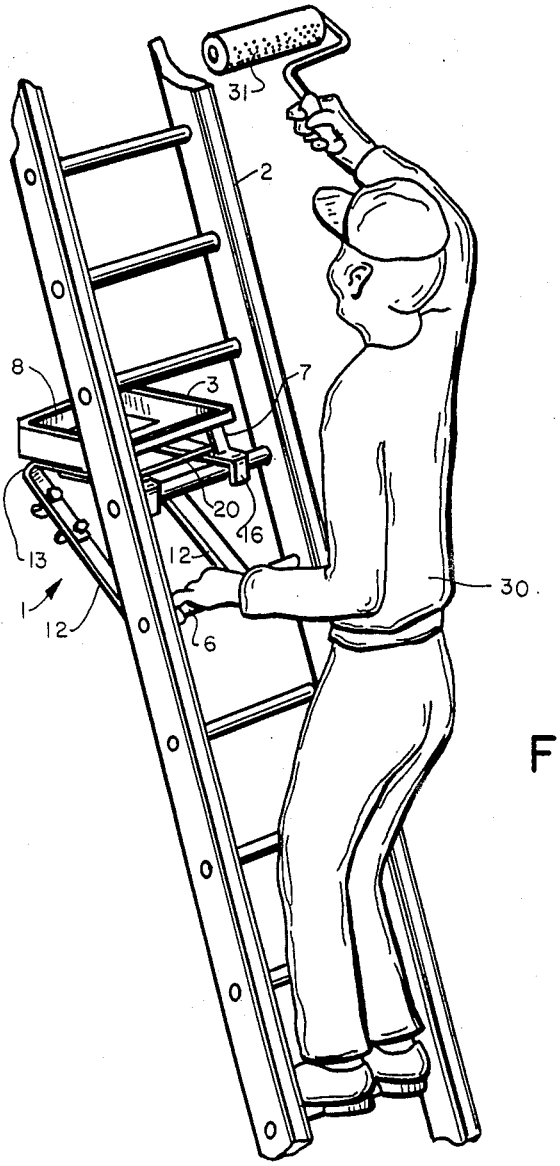
FIG. 4 is a perspective view of the improved device supporting a paint pan and removably mounted on a ladder which is resting against a structure to be painted.

Device 1 preferably is used in conjunction with rung-type ladders having the standard spacing of twelve inches between adjacent rungs 6 (FIGS. 1, 3 and 4). However, the device can be used with ladders having a non-standard spacing between adjacent rungs without effecting the concept of the invention, as will be described in detail below. Furthermore, device 1 is intended to support a paint pan of the type having at least one hook 7 extending downwardly therefrom and having a paint well 8 formed at an opposite end of the pan.

Device 1 includes a shelf, indicated generally at 11, and a pair of struts 12 adjustably attached thereto in a manner described below (FIG. 2). Shelf 11 comprises a pair of horizontally spaced, generally V-shaped brackets 13, each bracket having a horizontal leg 14 and an inwardly extending leg 15. Each horizontal leg 14 terminates in a downwardly extending vertical flange 16 for removably engaging one of the rungs 6 of ladder 2. Brackets 13 are connected by a first horizontal crossbar 20 which is attached to horizontal legs 14 by welds 17 and extends between the horizontal legs generally adjacent the flanged end thereof. A second horizontal crossbar 21 also extends between and is attached to horizontal legs 14 by welds 29 generally adjacent a junction 22 of the horizontal and inwardly extending legs of each of the brackets 13.

Crossbar 20 is mounted on horizontal legs 14 at an angle whereby an inwardly facing included angle 18 (FIG. 2) is formed between crossbar 20 and the horizontal legs whereby hooks 7 depending from the paint pan engage crossbar 20 within angle 18. Crossbar 21 further supports paint well 8 of pan 3 as shown particularly in FIG. 3. Thus, the paint pan is quickly and securely removably mounted on device 1 by engagement of depending hooks 7 with crossbar 20, and is adequately supported thereon by crossbar 21.

A pair of spaced, elongated longitudinally extending slots 23 (FIG. 2), preferably are formed in a first end 24 of each strut 12. The slots could be formed in inwardly extending legs 15 without effecting the concept of the invention. A plurality of bolts 25 pass through spaced openings formed in each inwardly extending leg 15 of shelf 11, and through aligned slots 23, whereby the struts are adjustably attached to the inwardly extending legs of the brackets by a plurality of wing nuts 26 which are threadably engaged with bolts 25. A second end 27 of each strut 12 has a generally upwardly extending, inwardly facing, inverted L-shaped extension 28 formed integral therewith for engaging the rung next below the ladder rung engaged by shelf 11 as shown in FIGS. 1 and 3.

The improved paint pan supporting device is used in the following manner. The device is removably mounted on adjacent rungs of the ladder, at a height thereon convenient for a painter 30 (FIG. 4) to place a roller 31 or brush in the paint well of the pan by engagement of vertical flanges 16 and L-shaped extensions 28 with a pair of spaced rungs. The paint pan then is removably mounted on the shelf of the device by engagement of hooks 7 with crossbar 20. The pan is securely supported on the device, thus reducing the risk of accidental spillage of paint from the pan in the event the pan, device or ladder is accidentally bumped or moved. Crossbar 21 provides support for the weight of the pan and the paint contained therein, as do the horizontal legs of the shelf brackets. Thus, the paint pan is securely removably supported on device 1, yet is quickly and easily mounted on or removed from the device for filling, etc. When it is necessary to move the paint pan to a different level on the ladder for access by the painter, the device 1 and supported paint pan may be removed from the ladder rungs as a unit and moved with little risk of spilled paint.

Additionally, the paint pan may either be filled with paint at ground level and carried up to the supporting device for quick and easy mounting of the pan thereon, or the pan may first be mounted on the device and then filled with paint from the paint can which is carried up to the level of the device and pan on the ladder. Some prior art paint pan supporting devices make it difficult to fill the pan in the former manner, because the pan is more difficult to engage and disengage from the device so that spillage of the paint is risked, a problem which is eliminated by the present invention.

In accordance with one of the main features of the invention, the shelf brackets, preferably being formed of lightweight, sturdy flexible metal straps, can be manually adjusted to compensate for ladders having a non-standard separation between adjacent rungs. An included angle 19 formed between the horizontal and inwardly extending legs of the brackets can be manually increased or decreased, and further the combined length of each of the pairs of inwardly extending legs and struts is adjustable for adapting the supporting device for use on such ladders. Each slot 23 preferably is one inch long, thereby making the maximum adjustment to said combined length one-half inch.

It is to be understood that the entire device can be formed of plastic or any other material having the qualities of flexibility, light weight and durability, without effecting the concept of the present invention.

In summary, the device of the present invention is easy to use and makes the painter's job easier, reduces the risk of spilled paint from the pan, and is durable yet inexpensive to purchase.

Accordingly, the improved paint pan supporting device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecesary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved paint pan supporting device is constructed and used, the characteristics of the construction, and the advantageous, new and useful results obtained; the new and useful structures, devices, elements, arrangements, parts, and combinations, are set forth in the appended claims.

What is claimed is:

1. A device for removably supporting a paint pan on rungs of a ladder, wherein said pan is of the type having at least one hook extending downwardly therefrom and having a paint well formed at an opposite end of the pan, said device including:

(a) a shelf comprising a pair of spaced, generally V-shaped brackets, said brackets each having a horizontal leg and an inwardly extending leg, said horizontal and inwardly extending legs forming included acute angles, said horizontal legs each terminating in a downwardly extending end flange for removably engaging a rung of a ladder;

(b) a first crossbar extending between the horizontal legs and located generally adjacent the end flanges thereof, said first crossbar being attached to the horizontal legs at an angle, said first crossbar and the horizontal legs forming an inwardly facing included acute angle, so that the hook depending from the paint pan removably engages said first crossbar within the included angle;

(c) a second crossbar extending between and attached to the horizontal legs of the shelf brackets for connecting said brackets, said second crossbar being located generally adjacent the junction of the horizontal and inwardly extending legs of each of said brackets for supporting the paint well of the paint pan; and (d) a pair of struts each adjustably attached at a first end thereof to the inwardly extending legs of the V-shaped brackets, said struts each having a bent second end for removably engaging a rung next below the ladder rung engaged by the shelf to position the horizontal legs for removably supporting the paint pan thereon.

2. The device defined in claim 1 in which a plurality of slots are formed in at least the struts; and in which fasteners extend through said slots and engage the inwardly extending legs of the brackets to adjustably attach the struts to said legs, to compensate for various separation between adjacent rungs.

3. The device defined in claim 1 in which the bent second end of each of the struts is generally L-shaped and is integral with the remaining portion of said struts.

4. The device defined in claim 1 in which the brackets are formed of flexible metal straps permitting manual adjustment of the angles formed by the horizontal and inwardly extending legs of said brackets.

* * * * *